US009941577B2

(12) United States Patent
Kim et al.

(10) Patent No.: US 9,941,577 B2
(45) Date of Patent: Apr. 10, 2018

(54) ANTENNA, CIRCULAR POLARIZED PATCH ANTENNA, AND VEHICLE HAVING THE SAME

(71) Applicant: Hyundai Motor Company, Seoul (KR)

(72) Inventors: Dongjin Kim, Seoul (KR); In Ho Kim, Incheon (KR)

(73) Assignee: Hyundai Motor Company, Seoul (KR)

( * ) Notice: Subject to any disclaimer, the term of this patent is extended or adjusted under 35 U.S.C. 154(b) by 71 days.

(21) Appl. No.: 14/563,670

(22) Filed: Dec. 8, 2014

(65) Prior Publication Data

US 2016/0118720 A1 Apr. 28, 2016

(30) Foreign Application Priority Data

Oct. 23, 2014 (KR) ..... 10-2014-0143926

(51) Int. Cl.

| | |
|---|---|
| ***H01Q 1/38*** | (2006.01) |
| ***H01Q 1/32*** | (2006.01) |
| ***H01Q 9/04*** | (2006.01) |
| ***H01Q 15/00*** | (2006.01) |

(52) U.S. Cl.

CPC ..... *H01Q 1/3275* (2013.01); *H01Q 9/0428* (2013.01); *H01Q 15/0086* (2013.01)

(58) Field of Classification Search

CPC . H01Q 1/3275; H01Q 9/0428; H01Q 15/0086
USPC ..... 343/700 MS
See application file for complete search history.

(56) References Cited

U.S. PATENT DOCUMENTS

| | | | | |
|---|---|---|---|---|
| 7,405,700 | B2 | 7/2008 | Duzdar et al. | |
| 2007/0052587 | A1* | 3/2007 | Cheng | H01Q 9/0407 343/700 MS |
| 2007/0296635 | A1* | 12/2007 | Popugaev | H01Q 9/0414 343/700 MS |
| 2009/0140927 | A1* | 6/2009 | Maeda | H01Q 9/0407 343/700 MS |
| 2010/0090903 | A1* | 4/2010 | Byun | H01Q 9/0407 343/700 MS |

(Continued)

FOREIGN PATENT DOCUMENTS

| | | | |
|---|---|---|---|
| JP | 2009-033707 | A | 2/2009 |
| KR | 10-2010-0105833 | A | 9/2010 |

(Continued)

OTHER PUBLICATIONS

Korean Notice of Allowance for Korean Application No. 10-2014-0143926, dated Mar. 22, 2016, English translation, 7 pages.

*Primary Examiner* — Jessica Han
*Assistant Examiner* — Jae Kim
(74) *Attorney, Agent, or Firm* — Mintz Levin Cohn Ferris Glovsky and Popeo, P.C.; Peter F. Corless

(57) ABSTRACT

An antenna, a circular polarized patch antenna, and a vehicle having the same are provided. The antenna includes a substrate, a ground portion formed on a first surface of the substrate, and a second radiator having a plurality of patches and formed on a second surface of the substrate. In addition, a first radiator is formed in a periphery of the second radiator with a gap from the second radiator and a feeding probe is disposed on the first radiator to enable power to be fed directly fed to the first radiator and to enable power to be fed to the second radiator through coupling.

9 Claims, 13 Drawing Sheets

(56) References Cited

U.S. PATENT DOCUMENTS

| | | | | |
|---|---|---|---|---|
| 2010/0109966 | A1* | 5/2010 | Mateychuk | A61N 1/37229 343/841 |
| 2012/0032869 | A1* | 2/2012 | Hawkins | H01Q 9/045 343/857 |
| 2012/0162021 | A1* | 6/2012 | Lee | H01Q 9/0428 343/700 MS |
| 2016/0190704 | A1* | 6/2016 | Celik | H01Q 15/0086 343/700 MS |

FOREIGN PATENT DOCUMENTS

| | | | |
|---|---|---|---|
| KR | 2012-0052784 | A | 5/2012 |
| KR | 10-2013-0017274 | A | 2/2013 |
| KR | 2013-0091603 | A | 8/2013 |

* cited by examiner (A) GPS BAND (B) SDARS BAND

ANTENNA, CIRCULAR POLARIZED PATCH ANTENNA, AND VEHICLE HAVING THE SAME

CROSS-REFERENCE TO RELATED APPLICATION

This application claims the benefit of Korean Patent Application No. P2014-143926, filed on Oct. 23, 2014 in the Korean Intellectual Property Office, the disclosure of which is incorporated herein by reference.

BACKGROUND

1. Field

The present invention relates to an antenna, and more particularly, to a circular polarized patch antenna.

2. Description of the Related Art

An integrated antenna for vehicles generally includes a global positioning system (GPS) function and a reception function of satellite digital audio radio service (SDARS). To implement the respective functions, a patch antenna that satisfies each of a GPS band and an SDARS band is used, but in this case, two patch antennas are required. In addition, to prevent the performance degradation between the two patch antennas and improve isolation, an interval between antenna elements should be spaced sufficiently apart from each other which may cause an increase in the overall size of the integrated antenna and an increase in the cost of the product.

SUMMARY

Therefore, an aspect of the present invention provides an antenna which may reduce the size (volume) of the antenna. In addition, the present invention provides an antenna which may reduce the cost of the antenna. Further, the present invention provides an antenna which may prevent performance degradation of the antenna and improve isolation. Additional aspects of the invention will be set forth in part in the description which follows and, in part, will be obvious from the description, or may be learned by practice of the invention.

In accordance with one aspect of the present invention, an antenna may include: a substrate; a ground portion formed on a first surface of the substrate; a second radiator including a plurality of patches and formed on a second surface of the substrate; a first radiator formed in a periphery of the second radiator with a gap from the second radiator; and a feeding probe disposed on the first radiator to enable power to be directly fed to the first radiator, and to enable power to be fed to the second radiator through coupling.

In particular, the first radiator may be a positive (+1) mode radiator, and the second radiator may be a negative (−1) mode radiator. The second radiator may be formed in a rectangular shape and may include a plurality of rectangular patches arranged in a line. The second radiator also include a plurality of rectangular patches divided into a quadrant. A first end of the feeding probe may prevent direct contact with the second radiator while electrically connected directly to the first radiator. A second end of the feeding probe may protrude from the second surface of the substrate while passing through an aperture formed in the substrate. In addition, a connector for electrical connection of a signal line may be disposed at the second end of the feeding probe.

In accordance with another aspect of the present invention, an antenna may include: a substrate; a ground portion formed on a first surface of the substrate; a second radiator including a plurality of patches and formed on a second surface of the substrate, the plurality of patches being connected to the ground portion through a plurality of vias; a first radiator formed in a periphery of the second radiator with a gap from the second radiator; and a feeding probe disposed on the first radiator to enable power to be directly fed to the first radiator, and to enable power to be fed to the second radiator through coupling.

In particular, the first radiator may be a positive (+1) mode radiator, and the second radiator may be a negative (−1) mode radiator. The second radiator may be formed in a rectangular shape and may include a plurality of rectangular patches arranged in a line. The second radiator may also include a plurality of rectangular patches divided into a quadrant. The plurality of vias may be made of metamaterials and the gap may be filled with metamaterials. Additionally, inductance may be determined based on a size of the via, and capacitance may be determined based on a width of the gap.

Furthermore, the feeding probe and the plurality of vias may be disposed on a single substantially straight line. The plurality of vias may be disposed on a single straight line, and the feeding probe may be disposed in a position deviated from the straight line. A first end of the feeding probe may prevent direct contact with the second radiator while electrically connected directly to the first radiator. A second end of the feeding probe may protrude from the second surface of the substrate while passing through a aperture formed in the substrate. In addition, a connector for electrical connection of a signal line may be disposed at the second end of the feeding probe.

In accordance with still another aspect of the present invention, a circular polarized patch antenna may include: a substrate; a ground portion formed on a first surface of the substrate; a second radiator having a plurality of patches may be formed on a second surface of the substrate; a first radiator formed in a periphery of the second radiator with a gap from the second radiator; and a feeding probe disposed on the first radiator to enable power to be directly fed to the first radiator, and to enable power to be fed to the second radiator through coupling.

In accordance with yet another aspect of the present invention, a vehicle may include an antenna mounted therein, wherein the antenna may include a substrate, a ground portion formed on a first surface of the substrate, a second radiator having a plurality of patches may be formed on a second surface of the substrate, a first radiator formed in a periphery of the second radiator with a gap from the second radiator, and a feeding probe disposed on the first radiator to enable power to be directly fed to the first radiator, and to enable power to be fed to the second radiator through coupling.

In accordance with further aspect of the present invention, a circular polarized patch antenna may include: a substrate; a ground portion formed on a first surface of the substrate; a second radiator having a plurality of patches may be formed on a second surface of the substrate, the plurality of patches being connected to the ground portion via a plurality of vias; a first radiator formed in a periphery of the second radiator with a gap from the second radiator; and a feeding probe disposed on the first radiator to enable power to be directly fed to the first radiator, and to enable power to be fed to the second radiator through coupling.

In accordance with further aspect of the present invention, a vehicle may include an antenna mounted therein, wherein the antenna may include a substrate, a ground portion formed on a first surface of the substrate, a second radiator having a plurality of patches may be formed on a second surface of the substrate, the plurality of patches being connected to the ground portion via a plurality of vias, a first radiator formed in a periphery of the second radiator with a gap from the second radiator, and a feeding probe disposed on the first radiator to enable power to be directly fed to the first radiator, and to enable power to be fed to the second radiator through coupling.

BRIEF DESCRIPTION OF THE DRAWINGS

These and/or other aspects of the invention will become apparent and more readily appreciated from the following description of the exemplary embodiments, taken in conjunction with the accompanying drawings of which.

DETAILED DESCRIPTION

Figure 1:
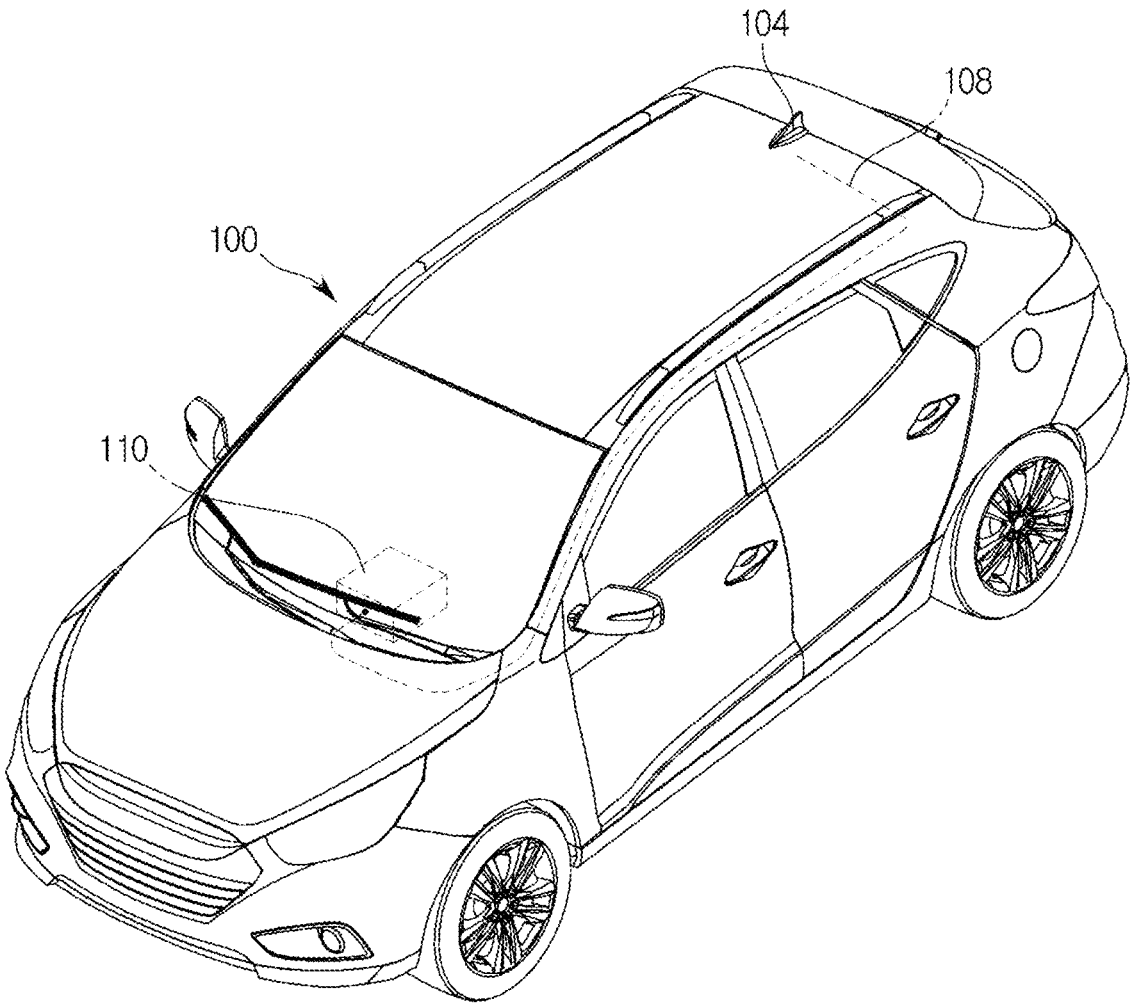
FIG. 1 is an exemplary view showing an antenna for a vehicle in accordance with one exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Reference will now be made in detail to the exemplary embodiments of the present invention, examples of which are illustrated in the accompanying drawings, wherein like reference numerals refer to like elements throughout.

FIG. 1 is an exemplary view showing an antenna for a vehicle in accordance with one exemplary embodiment of the present invention, and in FIG. 1, a shark fin type antenna 104 is disposed within a vehicle 100 and a cable arrangement is shown. As shown in FIG. 1, the antenna 104 for a vehicle may be fixedly disposed on a roof of the vehicle 100. The antenna 104 may be connected to a head unit 110 (e.g., audio/navigation/multimedia, and the like) on a side of a driver seat via a cable 108 for signal transmission. The arrangement of the cable 108 may be disposed along a lower space of the roof of the vehicle 100 or an inner space of the pillar.

Figure 2:
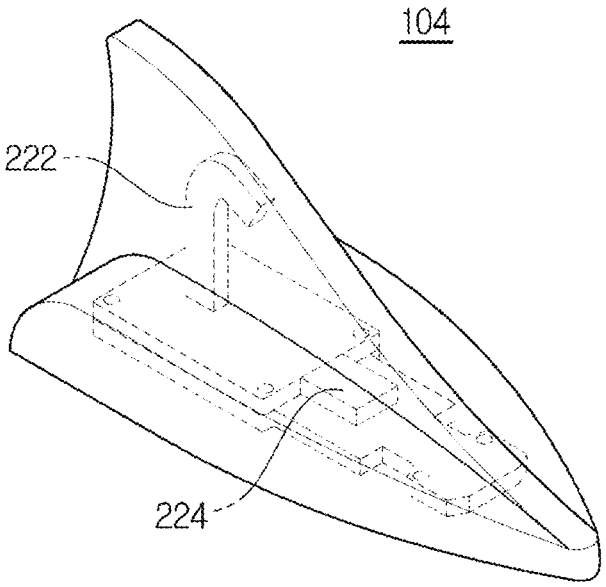
FIG. 2 is an exemplary view showing a structure of the antenna shown in FIG. 1 in accordance with one exemplary embodiment of the present invention.

FIG. 2 is an exemplary view showing a structure of the antenna shown in FIG. 1. In an inner space of the shark fin type antenna 104 shown in FIG. 2, a telematics reception antenna 222 responsible for reception of telematics signals is provided, and a circular polarized patch antenna 224 responsible for reception of global positioning system (GPS) signals and reception of satellite digital audio radio service (SDARS) signals is also provided. In other words, both the SDARS signal and the GPS signal may be received using one circular polarized patch antenna 224. Signals of a frequency band of the SDARS signals are signals of about 2.35 GHz band which is a substantially higher frequency band compared to a frequency band of the GPS signals. Signals of the frequency band of the GPS signals are signals of about 1.5 GHz band which is a substantially lower frequency band compared to the frequency band of the SDARS signals.

Figure 3:
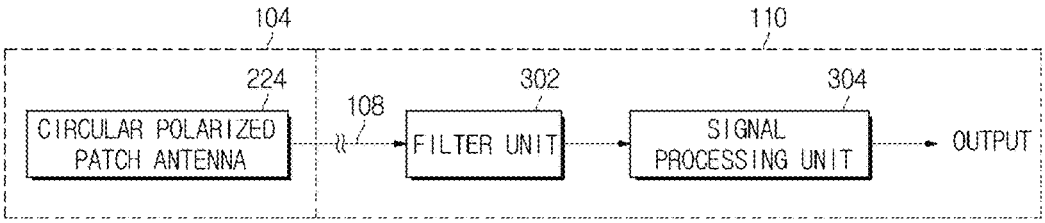
FIG. 3 is an exemplary view showing a configuration for signal processing of a circular polarized patch antenna of a vehicle in accordance with one exemplary embodiment of the present invention.

FIG. 3 is an exemplary view showing a configuration for signal processing of a circular polarized patch antenna of a vehicle in accordance with one exemplary embodiment of the present invention. As shown in FIG. 3, the circular polarized patch antenna 224 disposed on the roof of the vehicle 100 may be connected to a filter unit 302 of the head unit 110 via the cable 108. The filter unit 302 may be configured to filter signals received from the circular polarized patch antenna 224. The filtered signals may be subjected to processes such as frequency conversion, analog-to-digital conversion, and the like, and then may be output. Signals output from a signal processing unit 304 may be output as audio through a speaker, or output as video through a display.

Various examples of such a circular polarized patch antenna 224 according to an embodiment of the present invention will be described. The circular polarized patch antenna 224 according to an embodiment of the present invention includes a positive (+1) mode radiator and a negative (−1) mode radiator. The positive (+1) mode is a resonance mode corresponding to a positive magnitude, and the negative (−1) mode is a resonance mode corresponding to a negative magnitude.

First Exemplary Embodiment

Figure 4A:
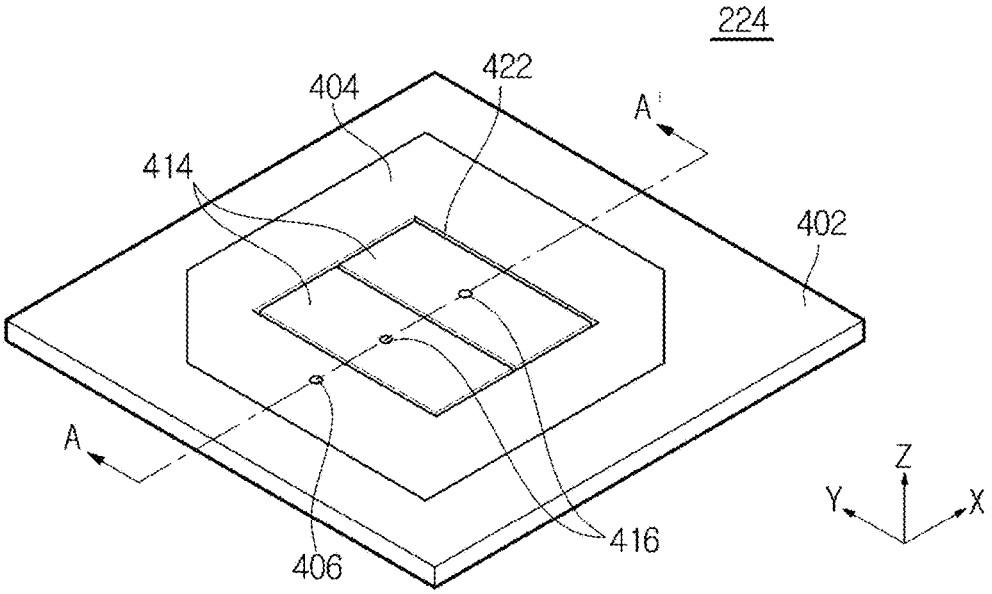
FIGS. 4A and 4B are exemplary views showing a circular polarized patch antenna in accordance with a first exemplary embodiment of the present invention.
Figure 4B:
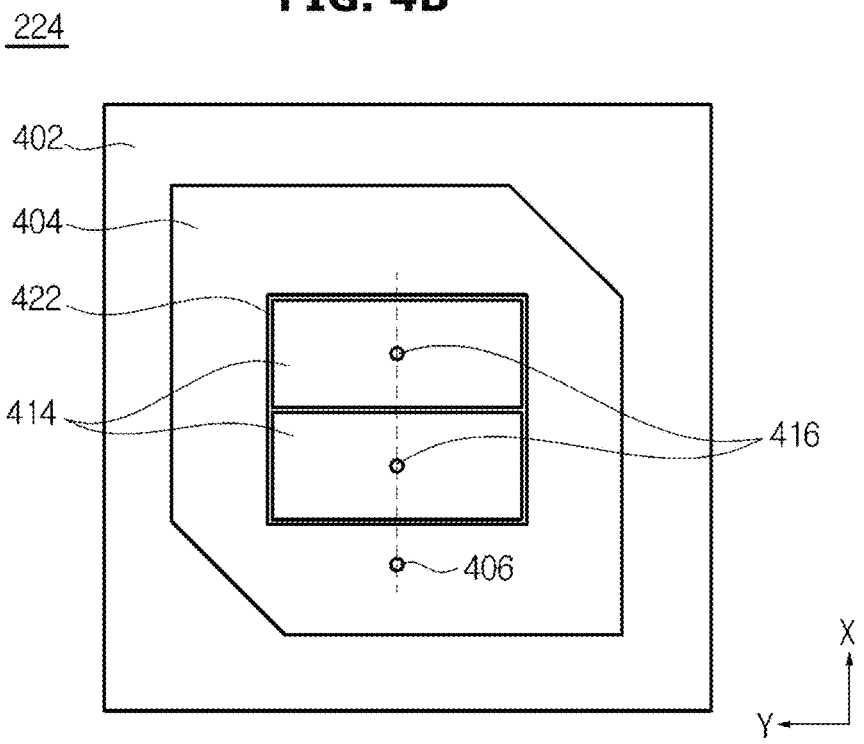

FIGS. 4A and 4B are exemplary views showing a circular polarized patch antenna in accordance with a first exemplary embodiment of the present invention. FIG. 4A is an exemplary perspective view of a plane of the circular polarized patch antenna 224, and FIG. 4B is an exemplary plan view of the circular polarized patch antenna 224. As shown in FIGS. 4A and 4B, in the circular polarized patch antenna 224 in accordance with the first exemplary embodiment of the present invention, a positive (+1) mode radiator 404 (first radiator) and a plurality of negative (−1) mode radiators 414 (second radiator) may be formed on a plane of a substrate 402.

The substrate 402 may be a printed circuit board (PCB) made of a dielectric material (for example, FR4). The substrate 402 may be formed to have a thickness of approximately 5 mm. An area of the substrate 402 is an area in which the positive (+1) mode radiator 404 and the negative (−1) mode radiator 414 may be received on a surface of a first side thereof and a ground portion (see 504 of FIG. 5) mat be received on a surface of a second side thereof. The area of the positive (+1) mode radiator 404 may be approximately 25×25 mm.

The positive (+1) mode radiator 404 formed on the plane of the substrate 402 may be used for reception of SDARS signals (e.g., reception of signals of approximately 2.35 GHz band). The positive (+1) mode radiator 404 may be a conductor (e.g., copper) formed in the form of a substantially thin film on the plane of the substrate 402. The positive (+1) mode radiator 404 may be formed in a rectangular band with a predetermined width. In other words, a conductive portion inside the rectangular conductive thin film may also be removed in a rectangular shape, and therefore another rectangle may be within the rectangle, and a space between the other rectangle and the rectangle may be filled with a conductive thin film. In the rectangular band shape of the positive (+1) mode radiator 404, the outer portion of any one pair of vertexes of two pairs of vertexes facing each other may be removed in a triangular shape (e.g., a type of chamfer shape). The length of one side of the outer periphery of the positive (+1) mode radiator 404 may be approximately 25 mm.

The negative (−1) mode radiator 414 formed on the substrate 402 may be used for reception of GPS signals (e.g., reception of signals of approximately 1.5 GHz band). The negative (−1) mode radiator 414 may be a conductor formed on the plane of the substrate 402 in the form of a thin film. The negative (−1) mode radiator 414 may be formed on the same plane as that of the positive (+1) mode radiator 404. The negative (−1) mode radiator 414 may be formed to be spaced apart by a predetermined interval from the positive (+1) mode radiator 404 in an inner region of the rectangular band shape of the positive (+1) mode radiator 404. Thus, a slit 422 with a predetermined size may be formed between the inside of the positive (+1) mode radiator 404 and the outside of the negative (−1) mode radiator 414. The slit 422 is made of metamaterials. The negative (−1) mode radiator 414 may include a plurality of rectangular patches. For the circular polarized patch antenna 224 according to the first exemplary embodiment of the present invention shown in FIGS. 4A and 4B, an example in which two rectangular patches constitute one negative (−1) mode radiator 414 is shown.

Horizontal and vertical lengths of each unit patch that forms a rectangle may be different, and the overall shape of the negative (−1) mode radiator 414 obtained such that the plurality of patches are combined may form a rectangle so horizontal and vertical lengths of the overall shape may be different. A plurality of vias 416 may be made of metamaterials and metamaterials constituting the slit 422 and the vias 416 may refer to materials having a periodic arrangement of meta atoms designed as metal or dielectric materials with significantly reduced sizes compared to their wavelengths.

The metamaterials are materials whose dielectric constant and permeability have a negative value as well as a positive value. In particular, a double negative (DNG) region is a region in which both the dielectric constant and the permeability have the negative value, and thus may have a resonance mode that corresponds to a negative magnitude. According to the present exemplary embodiment, the slit 422 and the vias 416 may be made of metamaterials, and therefore a serial inductor component may be formed, contributing to the miniaturization of the circular polarized patch antenna 224. In addition, the resonance mode of each of the positive (+1) mode radiator 404 and the negative (−1) mode radiator 414 may be respectively the positive (+1) mode and the negative (−1) mode, and therefore it is advantageous to ensure isolation between the positive (+1) mode radiator 404 and the negative (−1) mode radiator 414.

Each of the plurality of patches of the negative (−1) mode radiator 414 may be connected to the ground portion (see 504 of FIG. 5) formed on a rear surface of the substrate 402 via the plurality of vias 416. The plurality of patches and the plurality of vias 416 may form a mushroom shaped structure. In addition, in the circular polarized patch antenna 224 of FIGS. 4A and 4B, the positive (+1) mode radiator 404 and the negative (−1) mode radiator 414 may share a single feeding probe 406. The feeding probe 406 may be disposed on the positive (+1) mode radiator 404 with a first end of the feeding probe 406 being in direct contact with the positive (+1) mode radiator 404 and may be prevented from being in direct contact with the negative (−1) mode radiator 414. Accordingly, power may be directly fed to the positive (+1) mode radiator 404 through the feeding probe 406, and power may be indirectly fed to the negative (−1) mode radiator 414 through a coupling method.

In FIG. 4, both the plurality of vias 416 and the single feeding probe 406 may be arranged in a line. In other words, the feeding probe 406 may be disposed on a substantially straight line to virtually connect the plurality of vias 416. Accordingly, the positive (+1) mode radiator 404 and the negative (−1) mode radiator 414 may be substantially symmetric with respect to the virtual straight line, thereby exhibiting more stable frequency characteristics.

Figure 5:
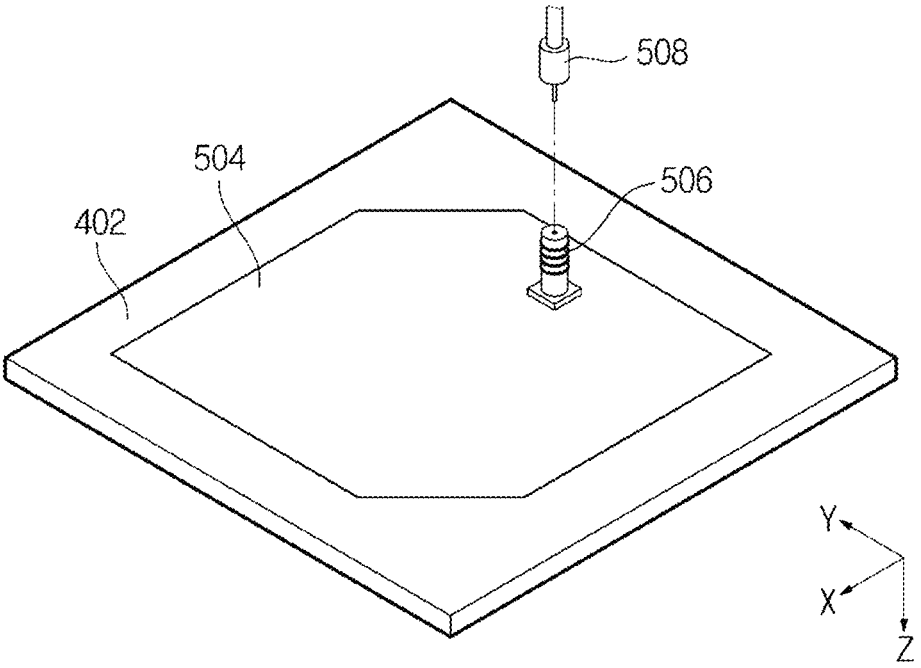
FIG. 5 is an exemplary view showing a rear surface of the circular polarized patch antenna shown in FIGS. 4A and 4B in accordance with an exemplary embodiment of the present invention.

FIG. 5 is an exemplary view showing a rear surface of the circular polarized patch antenna shown in FIGS. 4A and 4B. That is, FIG. 5 is an exemplary perspective view at a point of view seen from the rear surface of the circular polarized patch antenna 224. On the rear surface of the substrate 402 of the circular polarized patch antenna 224, a ground portion 504 made of a conductor in the form of a substantially thin film may be formed. In addition, a connector 506 may be fixed on the rear surface of the substrate 402 of the circular polarized patch antenna 224. The connector 506 may be electrically connected to a second end of the feeding probe 406. The connector 506 may be a connector configured to connect a coaxial cable. In addition, the connector 506 may be a connector configured to connect a coaxial probe. A cable 508 connected to the connector 506 may be connected to the signal processing unit 304 via the filter unit 302.

Figure 6:
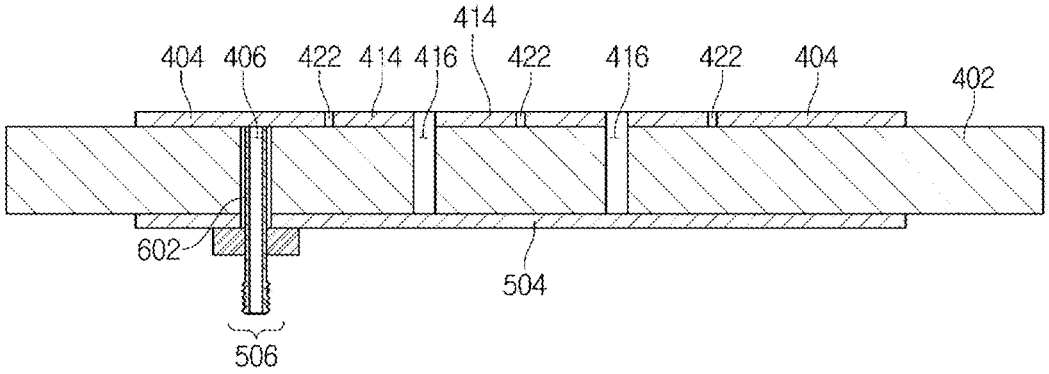
FIG. 6 is an exemplary A-A' cross-sectional view of the circular polarized patch antenna of FIGS. 4A and 4B in accordance with an exemplary embodiment of the present invention.

FIG. 6 is an exemplary A-A' cross-sectional view of the circular polarized patch antenna of FIGS. 4A and 4B. The cross-sectional view of FIG. 6, shows how the positive (+1) mode radiator 404 and the negative (−1) mode radiator 414 may be connected to the ground portion 504 via the plurality of vias 416. In addition, the cross-sectional view of FIG. 6 shows a connection relationship between the feeding probe 406 and the connector 506.

As shown in FIG. 6, the plurality of patches constituting the negative (−1) mode radiator 414 may be connected to the ground portion 504 via the plurality of vias 416. The plurality of vias 416 may be inserted into via apertures that through the substrate 402, and therefore the plurality of patches of the negative (−1) mode radiator 414 and the ground portion 504 may be electrically connected. In addition, the feeding probe 406 may be inserted into an aperture 602 formed in the substrate 402, to electrically connect a first end of the feeding probe 406 to the positive (+1) mode radiator 404 and connect a second end of the feeding probe 406 to the connector 506. The feeding probe 406 may have a sufficient length to allow the second other end of the feeding probe 406 to protrude to the exterior from the rear surface of the substrate 402. The feeding probe 406 may be configured to prevent contact with the substrate 402 and the ground portion 504 while passing through the aperture 602.

Figure 7:
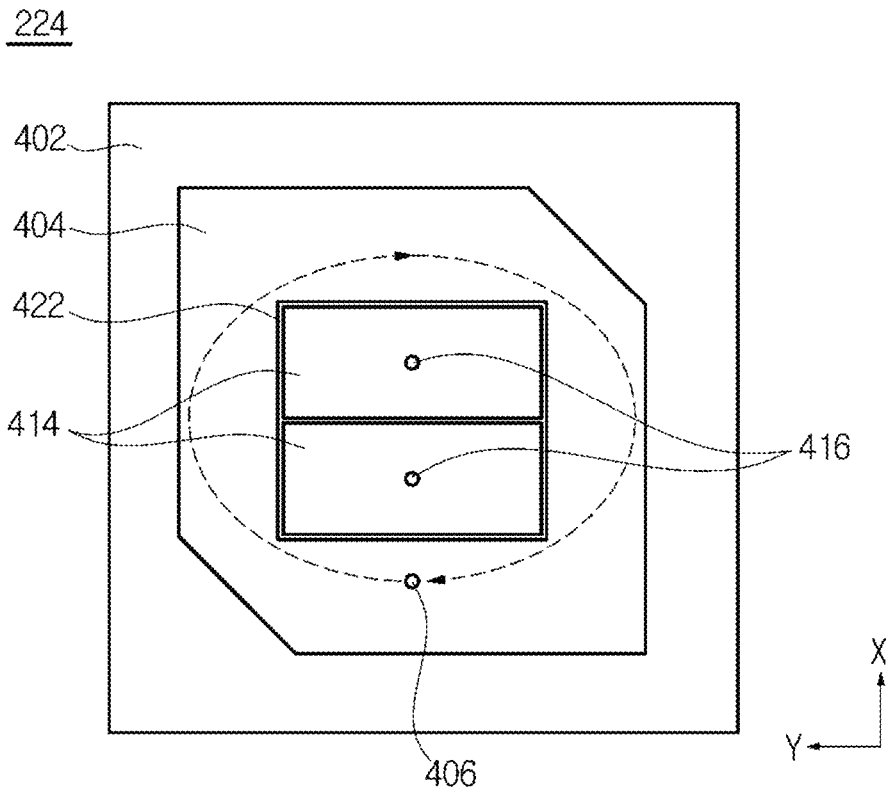
FIG. 7 is an exemplary view showing direct feeding of a circular polarized patch antenna in accordance with one exemplary embodiment of the present invention.

FIG. 7 is an exemplary view showing direct feeding of a circular polarized patch antenna in accordance with one exemplary embodiment of the present invention. As shown in FIG. 7, when power is fed to the positive (+1) mode radiator 404 via the feeding probe 406, a circular polarized wave may be generated as indicated by the arrow while power is fed along the rectangular band shaped-positive (+1) mode radiator 404. By the generation of the circular polarized wave, radiation of signals of the SDARS band (approximately 2.35 GHz band) may be performed.

Figure 8A:
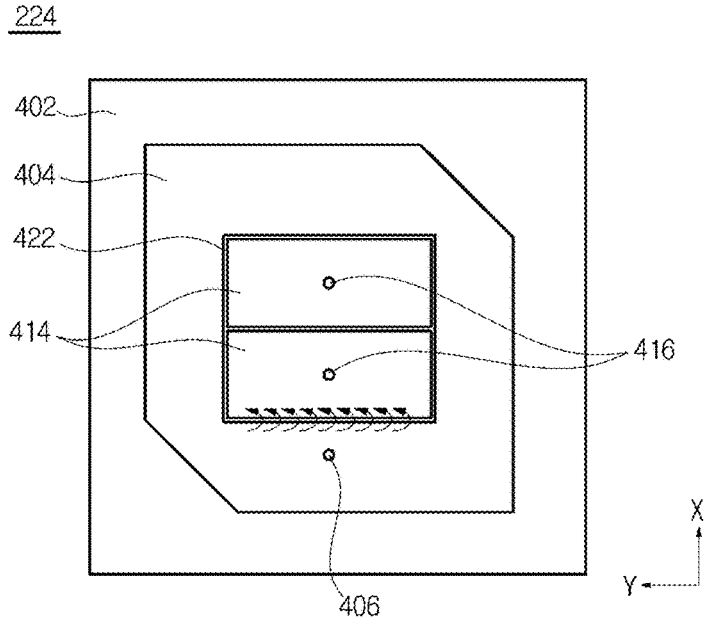
FIGS. 8A and 8B are exemplary views showing coupling feeding of a circular polarized patch antenna in accordance with one exemplary embodiment of the present invention.
Figure 8B:
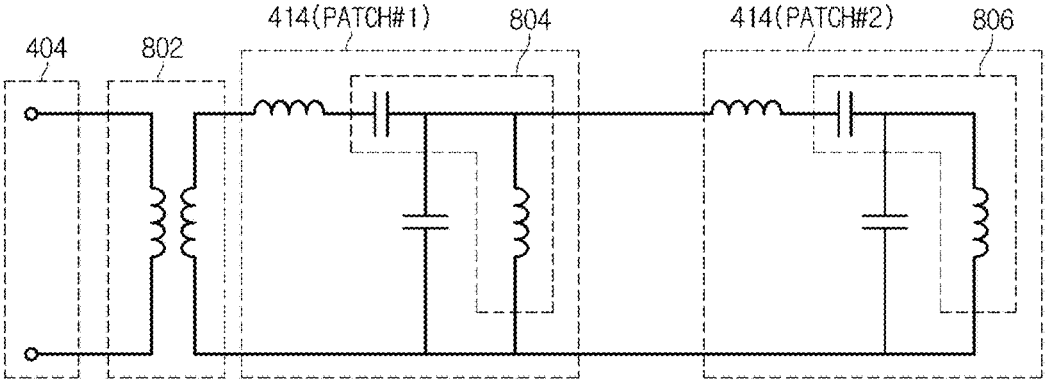

FIGS. 8A and 8B are exemplary views showing coupling feeding of a circular polarized patch antenna in accordance with one exemplary embodiment of the present invention. FIG. 8A is an exemplary view showing coupling between the positive (+1) mode radiator 404 and the negative (−1) mode radiator 414, and FIG. 8B is an exemplary equivalent circuit diagram of the circular polarized patch antenna 224 shown in FIG. 8A.

As shown in FIG. 8A, in the circular polarized patch antenna 224 according to an exemplary embodiment of the present invention, the feeding probe 406 may be directly connected to the positive (+1) mode radiator 404, and indirectly connected to the negative (−1) mode radiator 414. Thus, power may be fed directly to the positive (+1) mode radiator 404 from the feeding probe 406, and may be fed to the negative (−1) mode radiator 414 through coupling between the positive (+1) mode radiator 404 to which power may be fed and the negative (−1) mode radiator 414 to which power may not be fed. Through power feeding in such a coupling method, radiation of signals of the GPS band (approximately 1.5 GHz band) may be performed.

As shown in FIG. 8B, power feeding may be performed through coupling 802 between the positive (+1) mode radiator 404 and the negative (−1) mode radiator 414. The plurality of patches #1 and #2 constituting the negative (−1) mode radiator 414 may include a basic inductance component and capacitance component. In addition, as shown in a block 804, the patch #1 of the negative (−1) mode radiator 414 may further include an additional inductance component generated by any one of the plurality of vias 416 and an additional capacitance component generated by a gap of the slit 422. As shown in a block 806, the patch #2 of the negative (−1) mode radiator 414 may further include an additional inductance component generated by the other one of the plurality of vias 416 and an additional capacitance component generated by the gap of the slit 422. Accordingly, the inductance component and the capacitance component of the negative (−1) mode radiator 414 may be adjusted by designing and changing the shapes of the plurality of vias 416 and the slit 422. In addition, greater inductance component and capacitance component may be generated without adding separate additional inductance component and capacitance component, and therefore greater signals may be received by an antenna of a reduced size.

Figure 9:
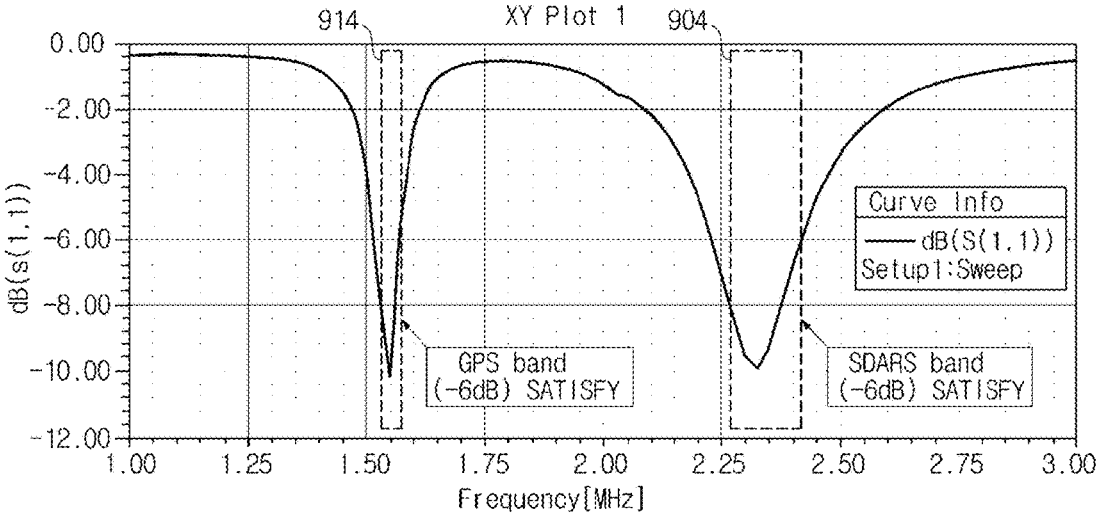
FIG. 9 is an exemplary view showing frequency characteristics (reflection coefficient) of a circular polarized patch antenna in accordance with one exemplary embodiment of the present invention.

FIG. 9 is an exemplary view showing frequency characteristics (e.g., reflection coefficient) of a circular polarized patch antenna in accordance with one exemplary embodiment of the present invention. As shown in FIG. 9, a significantly low reflection loss of about −6 dB or less may be generated in both the GPS band (approximately 1.5 GHz band) and the SDARS band (approximately 2.35 GHz band).

Figure 10:
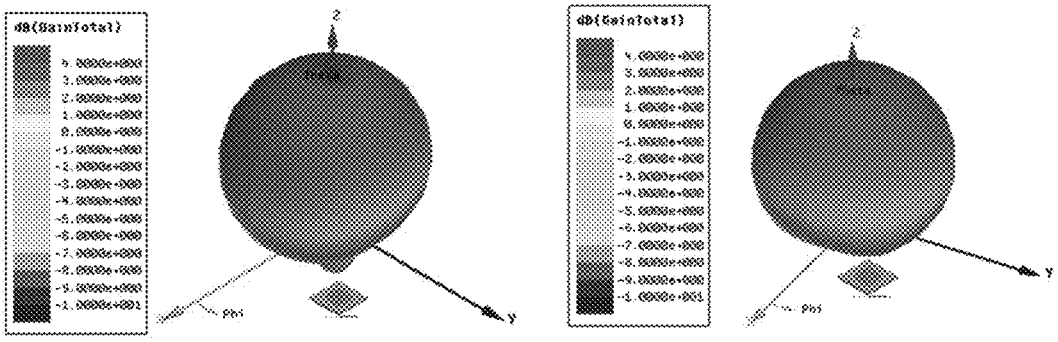
FIG. 10 is an exemplary view showing gain characteristics (radiation directivity) of a circular polarized patch antenna in accordance with one exemplary embodiment of the present invention.

FIG. 10 is an exemplary view showing gain characteristics (e.g., radiation directivity) of a circular polarized patch antenna in accordance with one exemplary embodiment of the present invention. As shown in FIG. 10, radiation may be performed in both the GPS band (approximately 1.5 GHz band) and the SDARS band (approximately 2.35 GHz band), in an upper direction of the circular polarized patch antenna 224. In accordingly, since the radiation may be performed in the upper direction of the circular polarized patch antenna 224, satellite signals of the circular polarized patch antenna 224 may be received according to an exemplary embodiment of the present invention.

Second Exemplary Embodiment

Figure 11A:
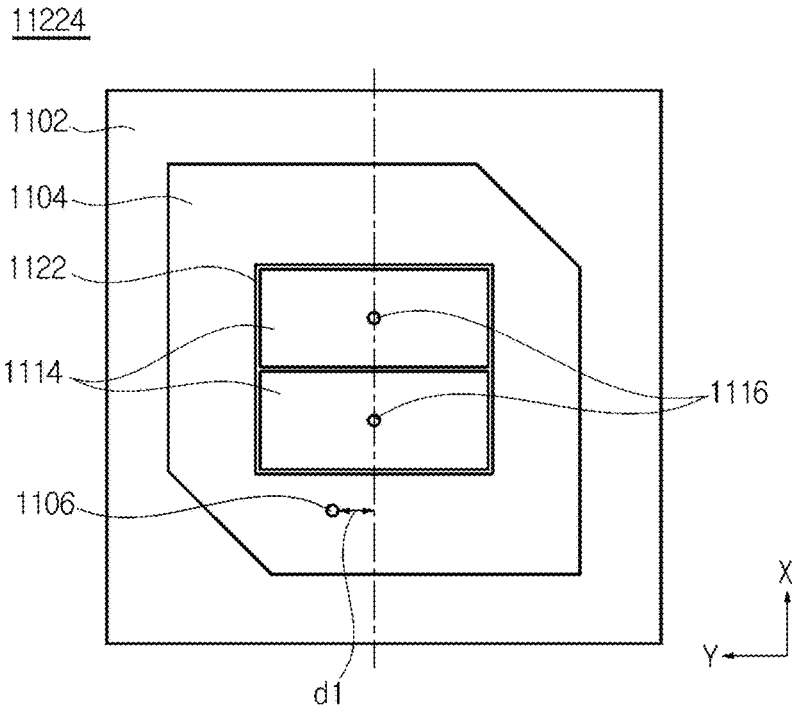
FIGS. 11A and 11B are exemplary views showing a circular polarized patch antenna in accordance with a second exemplary embodiment of the present invention.
Figure 11B:
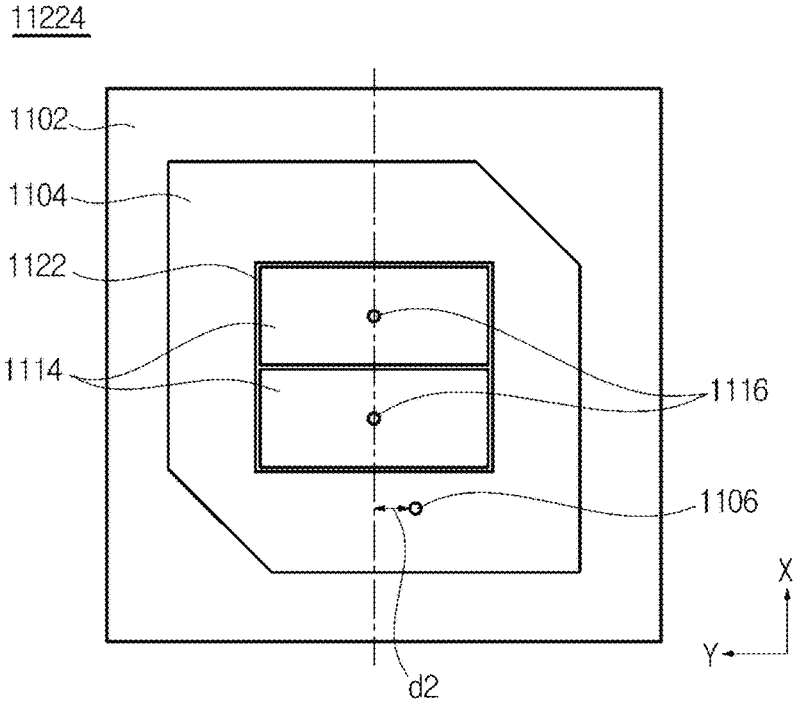

FIGS. 11A and 11B are exemplary views showing a circular polarized patch antenna in accordance with a second exemplary embodiment of the present invention. A circular polarized patch antenna 11224 according to a second exemplary embodiment of the present invention is an exemplary embodiment in which a feeding probe 1106 may be disposed in a position deviated from a substantially straight line to virtually connect a plurality of vias 1116.

As shown in FIG. 11A, the feeding probe 1106 may be disposed in a position apart by a distance d1 to the left side on the substantially straight line to virtually connect the plurality of vias 1116, and therefore characteristics of direct power feeding of a positive (+1) mode radiator 1104 and coupling power feeding of a negative (−1) mode radiator 1114 may be changed. In addition, as shown in FIG. 11B, the feeding probe 1106 may be disposed in a position apart by a distance d2 to the right side on the straight line to virtually connect the plurality of vias 1116, and therefore characteristics of direct power feeding of the positive (+1) mode radiator 1104 and coupling power feeding of the negative (−1) mode radiator 1114 may be changed. Using such changes in power feeding characteristics, the frequency characteristics of the circular polarized patch antenna 11224 according to the second exemplary embodiment of the present invention may be changed to a desired form.

Third Exemplary Embodiment

Figure 12:
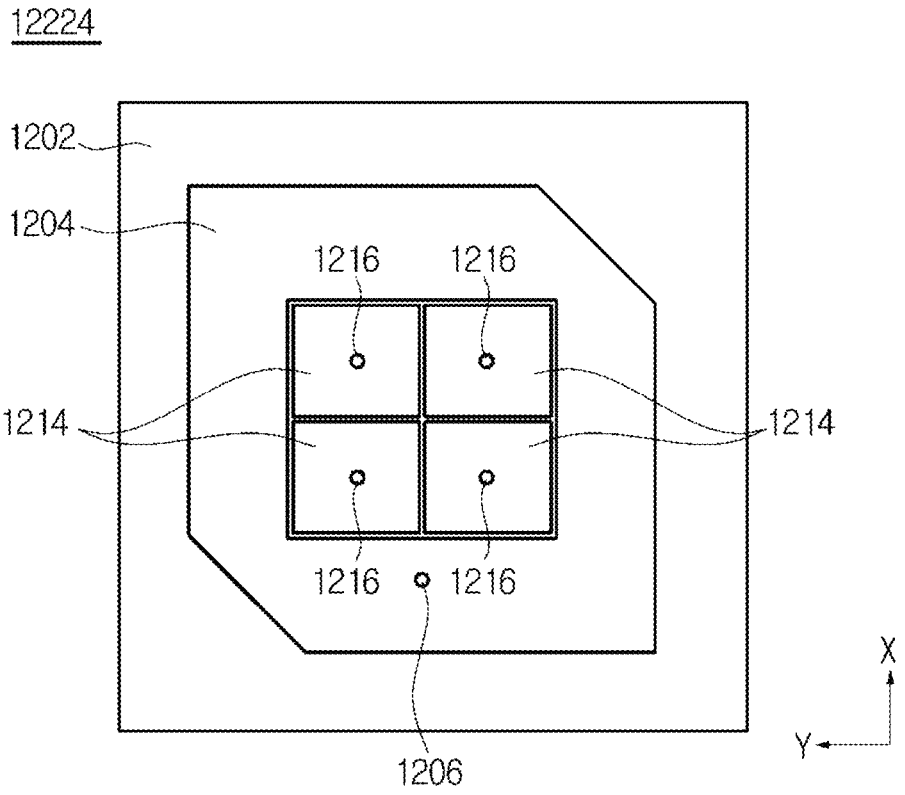
FIG. 12 is an exemplary view showing a circular polarized patch antenna in accordance with a third exemplary embodiment of the present invention.

FIG. 12 is an exemplary view showing a circular polarized patch antenna in accordance with a third exemplary embodiment of the present invention. In a circular polarized patch antenna 12224 according to a third exemplary embodiment of the present invention shown in FIG. 12, a negative (−1) mode radiator 1214 may include a plurality of rectangular patches divided into a quadrant. In particular, vias 1216 may be disposed in each of the plurality of rectangular patches of the circular polarized patch antenna 12224 according to the third exemplary embodiment of the present invention. In the circular polarized patch antenna 12224 according to the third exemplary embodiment of the present invention, a feeding probe 1206 may be disposed on a positive (+1) mode radiator 1204 with a first end of the feeding probe 1206 in direct contact with the positive (+1) mode radiator 1204 and in indirect contact with the negative (−1) mode radiator 1214. Accordingly, power may be fed directly to the positive (+1) mode radiator 1204 via the feeding probe 1206, and power may be fed indirectly to the negative (−1) mode radiator 1214 in the coupling method.

Fourth Exemplary Embodiment

Figure 13:
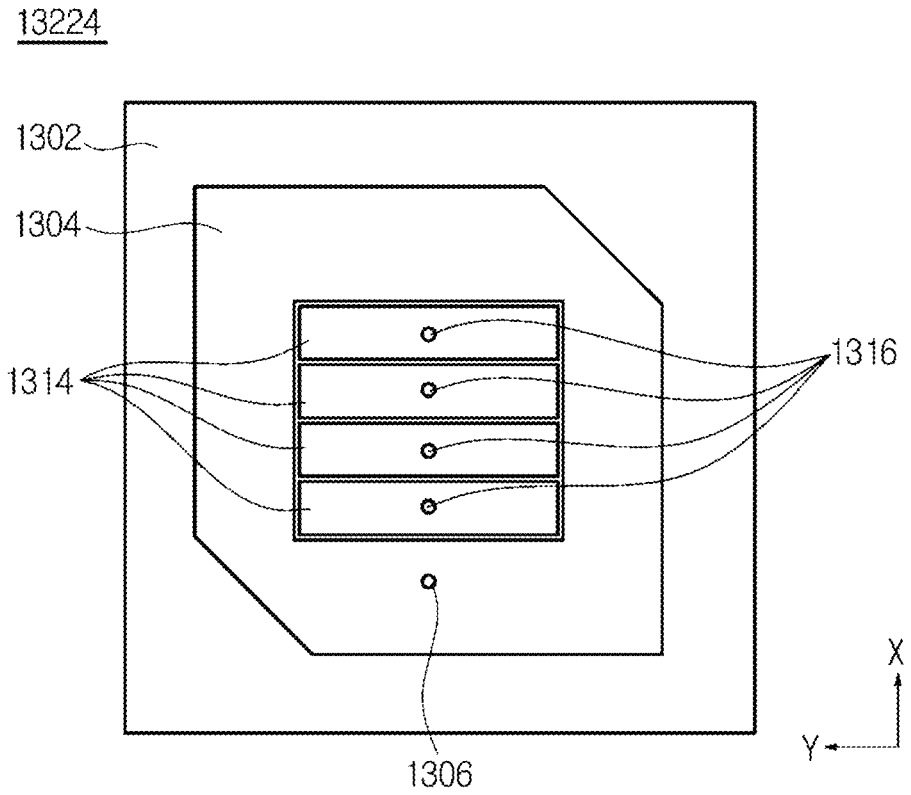
FIG. 13 is an exemplary view showing a circular polarized patch antenna in accordance with a fourth exemplary embodiment of the present invention.

FIG. 13 is an exemplary view showing a circular polarized patch antenna in accordance with a fourth exemplary embodiment of the present invention. In a circular polarized patch antenna 13224 according to a fourth exemplary embodiment of the present invention shown in FIG. 13, a negative (−1) mode radiator 1314 may include a plurality of rectangular patches arranged in a line. The plurality of rectangular patches of the circular polarized patch antenna 13224 according to the fourth exemplary embodiment of the present invention may be arranged in a line in a direction of a substantially straight line to virtually connect a plurality of vias 1316 and a feeding probe 1306. The vias 1316 may be disposed in each of the plurality of rectangular patches of the circular polarized patch antenna 13224 according to the fourth exemplary embodiment of the present invention. In the circular polarized patch antenna 13224 according to the fourth exemplary embodiment of the present invention, the feeding probe 1306 may be disposed on a positive (+1) mode radiator 1304 with a first end of the feeding probe 1306 in direct contact with the positive (+1) mode radiator 1304 and in indirect contact with the negative (−1) mode radiator 1314. Accordingly, power may be fed directly to the positive (+1) mode radiator 1304 via the feeding probe 1306, and power may be fed indirectly to the negative (−1) mode radiator 1314 in the coupling method.

As is apparent from the above description, the number of antenna elements may be reduced. In other words, both the GPS band and the SDARS band may be satisfied with one antenna, and therefore the number of antenna elements may be reduced to one. In addition, the cost may be reduced. In other words, only one antenna element may be used, and therefore cost reduction effects of about 50% compared to when using two antenna elements may be expected.

In addition, the volume of the antenna may be reduced. Since only one antenna element may be used, volume reduction effects of about ½ compared to when using two antenna elements may be expected. In addition, only one antenna element rather than two antenna elements may be used thus eliminating the requirement of a separation distance between the two antenna elements, and therefore improved isolation characteristics may be ensured even while sharing one radiator.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. An antenna comprising:

a substrate;

a ground portion formed on a first surface of the substrate;

a second radiator having a plurality of patches and formed on a second surface of the substrate, the plurality of patches being connected to the ground portion via a plurality of vias;

a first radiator formed in a periphery of the second radiator spaced apart from the second radiator on the second surface of the substrate; and a feeding probe disposed on the first radiator to enable power to be fed directly to the first radiator, and to enable power to be fed to the second radiator through coupling, wherein the plurality of vias are made of metamaterials, wherein the second radiator is formed in a rectangular shape, and wherein a first end of the feeding probe prevents direct contact with the second radiator while being electrically connected directly to the first radiator.

2. The antenna according to claim 1, wherein the second radiator includes a plurality of rectangular patches arranged in a line.

3. The antenna according to claim 1, wherein the second radiator includes a plurality of rectangular patches divided into a quadrant.

4. The antenna according to claim 1, wherein a gap between the first radiator and the second radiator is filled with metamaterials.

5. The antenna according to claim 1, wherein inductance of the first and second radiators is determined based on a size of the via, and capacitance of the first and second radiators is determined based on a width of a gap between the first radiator and the second radiator.

6. The antenna according to claim 1, wherein the feeding probe and the plurality of vias are disposed on a single straight line.

7. The antenna according to claim 1, wherein the plurality of vias are disposed on a single straight line, and the feeding probe is disposed in a position deviated from the straight line.

8. The antenna according to claim 1, wherein a second end of the feeding probe protrudes from the second surface of the substrate while passing through an aperture formed in the substrate.

9. The antenna according to claim 8, wherein a connector for electrical connection of a signal line is disposed at the second end of the feeding probe.

* * * * *